US005443918A

United States Patent [19]

Banthia et al.

[11] Patent Number: 5,443,918

[45] Date of Patent: Aug. 22, 1995

[54] METAL FIBER WITH OPTIMIZED GEOMETRY FOR REINFORCING CEMENT-BASED MATERIALS

[75] Inventors: Nemkumar Banthia, Burnaby; Madhavarao Krishnadev, Sainte-Foy, both of Canada

[73] Assignee: Universite Laval, Quebec, Canada

[21] Appl. No.: 301,577

[22] Filed: Sep. 7, 1994

[51] Int. Cl.[6] ..... E04C 5/03

[52] U.S. Cl. ..... 428/603; 106/644; 52/659

[58] Field of Search ..... 428/603, 605, 606; 106/640, 641, 644; 52/659

[56] References Cited

U.S. PATENT DOCUMENTS

| | | | |
|---|---|---|---|
| 2,274,699 | 3/1942 | Jacobs | 428/603 |
| 2,677,955 | 5/1954 | Constantinesco | 52/659 |
| 3,429,094 | 2/1969 | Romualdi | 52/659 |
| 3,728,211 | 4/1973 | Ball et al. | 106/644 |
| 3,900,667 | 8/1975 | Moens | 428/603 |
| 3,942,955 | 3/1976 | Moens | 52/659 |
| 4,585,487 | 4/1986 | Destree et al. | 106/644 |
| 4,883,713 | 11/1989 | Destree et al. | 428/606 |
| 5,215,830 | 6/1993 | Cinti | 428/603 |

FOREIGN PATENT DOCUMENTS

| | | | |
|---|---|---|---|
| 926146 | 5/1973 | Canada . | |
| 1023395 | 12/1977 | Canada . | |
| 59-150113 | 8/1984 | Japan | 428/603 |
| 1446855 | 8/1976 | United Kingdom | 52/659 |

OTHER PUBLICATIONS

J. P. Romualdi et al., "Tensile Strength of Concrete Affected by Uniformly Distributed and Closely Spaced Short Lengths of Wire Reinforcement", Journal of The American Concrete Institute, Jun. 1964, pp. 657–670.

Dramix Steel Fibers, "The Miracle in the Mix", Bekaert Steel Wire Corp., brochure, Aug. 1979, 5 pages.

*Primary Examiner*—John Zimmerman

*Attorney, Agent, or Firm*—Foley & Lardner

[57] ABSTRACT

A metal fiber for reinforcing cement-based materials comprises an elongated, substantially straight central portion and sinusoid shaped end portions. The sinusoid at each end portion has an optimum amplitude $A_{o,opt}$ defined by:

$$A_{o,opt}=[k_1(\sigma_c)^{k_2}][\sigma_u^{\alpha}\epsilon_f^{\beta}][A_f/P_f]$$

where $k_1=2.025\times10^{-2}$, $\sigma_c$=compressive strength of the cement-based material in MPa, $k_2=3.19\times10^{-1}$, $\sigma_u$=ultimate tensile strength of the metal in MPa, $\alpha=6.60\times10^{-1}$ $\epsilon_f$=ductility of the metal in percent, and $\beta=3.20\times10^{-1}$, $A_f$=cross-sectional area of the fiber in mm$^2$, and $P_f$=perimeter of the fiber in mm.

The sinusoid further has a wavelength $L_s$ defined by:

$$L_s=(L_f-L_m)/2$$

where $L_f$=length of the fiber, $L_m$=length of the central portion, and wherein $0.5\ L_f<L_m<0.75\ L_f$. Since the optimum amplitude is defined as a function of the ultimate tensile strength and ductility of the fiber material as well as of the compressive strength of the matrix material, it is possible to tailor the fiber geometry according to the properties of the fiber and matrix materials chosen, and ultimately to the composite toughness desired in an actual structure.

28 Claims, 2 Drawing Sheets

METAL FIBER WITH OPTIMIZED GEOMETRY FOR REINFORCING CEMENT-BASED MATERIALS

BACKGROUND OF THE INVENTION

The present invention pertains to improvements in the field of fiber reinforced cement-based materials. More particularly, the invention relates to a metal fiber having an optimized geometry for reinforcing cement-based materials.

All cement-based materials are weak in tension. In addition, these materials have a very low strain capacity which places them in a brittle category with other brittle materials such as glass and ceramics. It is well known that concrete and other portland cement-based materials may be reinforced with short, randomly distributed fibers of steel to improve upon their mechanical properties. It is also known that for any improvement in the tensile strength, fiber volume fraction has to exceed a certain critical value.

Beyond matrix cracking, fibers form stress transfer bridges and hold matrix cracks together such that a further crack opening or propagation causes the fibers to undergo pull-out from the matrix. Pull-out processes being energy intensive, steel fiber reinforced concrete exhibits a stable load-deflection behavior in the region beyond matrix-cracking which places these materials in a category of pseudo-plastic or tough materials such as steel and polymers. Thus, while a plain unreinforced matrix fails in a brittle manner at the occurrence of cracking stresses, the ductile fibers in fiber reinforced concrete continue to carry stresses beyond matrix cracking which helps maintaining structural integrity and cohesiveness in the material. Further, if properly designed, fibers undergo pull-out processes and the frictional work needed for pull-out leads to a significantly improved energy absorption capability. Therefore, fiber reinforced concrete exhibits better performance not only under static and quasi-statically applied loads but also under fatigue, impact and impulsive loadings. This energy absorption attribute of fiber reinforced concrete is often termed "toughness".

Concrete is a strain-softening, micro-cracking material. In steel fiber reinforced cement-based composites, fiber bridging action sets in even prior to the occurrence of the perceived matrix macro-cracking. The critical fiber volume fraction or the magnitude of strength improvement at a certain fiber volume fraction, therefore, depends upon the geometry of the fiber. Also dependent upon the geometry is the pull-out resistance of an individual fiber from the cementitious matrix around it, which in turn, governs the shape of the load-deflection plot beyond matrix cracking and the achievable improvement in composite toughness.

An improvement in the strength of the composite at a certain fiber volume fraction or, in other words, a reduction in the required critical fiber volume fraction, is possible by excessively deforming the fiber. However, this may lead to too good a fiber anchorage with the matrix and causes a brittle mode of fracture in the post-matrix cracking region. Toughness reductions in the case of excessively deformed fibers, therefore, can be significant. The other possible way is to increase the number of fibers in the composite by reducing the size of the fibers. This solution is known to cause extreme difficulties in terms of concrete mixing and workability, and uniform fiber dispersion often becomes impossible as the fibers tend to clump together giving a highly non-uniform distribution.

In U.S. Pat. No. 4,585,487, which proposes a concrete-reinforcing fiber having uniform wave shaped corrugations distributed over its entire length, the sole fiber performance characteristics considered for optimization is the fiber pull-out performance. The same also applies in respect of Canadian Patent Nos. 926,146 and 1,023,395, which disclose concrete-reinforcing fibers having a straight central portion with shaped ends. Some fibers have ends which are formed thicker; others have ends which are hooked. All these characteristics are intended to improve anchoring of the fiber in the concrete.

For fibers that are used as a reinforcement distributed randomly in a moldable concrete matrix, the property of interest is the overall composite toughness. The composite toughness, although dependent on the pull-out resistance of fibers, cannot quantitatively be derived from the results of an ideal fiber pull-out test where the fiber is aligned with respect to the load direction, since in a real composite, once the brittle cementitious matrix cracks, the fibers are not only embedded to various depths on both sides of the matrix but also inclined at various angles with respect to the loading direction. Further, fibers pulling out as a bundle have a very different performance as compared to a single fiber owing primarily to fiber-fiber interaction. Also, in a real composite, the contribution from the matrix is not entirely absent while fibers are pulling out (as assumed in an ideal pull-out test) due to aggregate interlocking, discontinuous cracking and crack bands. Thus, the idealistic single fiber pull-out test with the fiber aligned with respect to the loading direction is not a realistic representation of what is happening in a real composite. So far, no attempt has been made to rationally optimize the fiber geometry with respect to the properties of the matrix material, i.e. concrete, and the fiber material, i.e. steel or other metal.

SUMMARY OF THE INVENTION

It is therefore an object of the present invention to relate the fiber geometry to the properties of both the matrix and fiber materials, with a view to optimizing the overall composite toughness.

It is another object of the invention to provide a metal fiber with an optimized geometry for reinforcing cement-based materials such that the fiber fully utilizes matrix anchoring without fracturing in the pre-matrix macro-cracking region and pulls out at the maximum pull-out resistance in the post-matrix macro-cracking region giving the highest possible toughness.

In accordance with the present invention, there is thus provided a metal fiber for reinforcing cement-based materials, which comprises an elongated, substantially straight central portion and sinusoid shaped end portions. The sinusoid at each end portion has an optimum amplitude $A_{o,opt}$ defined by:

$$A_{o,opt}=[k_1(\sigma_c)^{k_2}][\sigma_u^{\alpha}\epsilon_f^{\beta}][A_f/P_f] \quad (1)$$

where $k_1=2.025\times10^{-2}$, $\sigma_c$=compressive strength of the cement-based material in MPa, $k_2=3.19\times10^{-1}$, $\sigma_u$=ultimate tensile strength of the metal in MPa, $\alpha = 6.60 \times 10^{-1}$, $\epsilon_f$ = ductility of the metal in percent, and $\beta = 3.20 \times 10^{-1}$, $A_f$ = cross-sectional area of the fiber in $mm^2$, and $P_f$ = perimeter of the fiber in mm.

The sinusoid further has a wavelength $L_s$ defined by:

$$L_s = (L_f - L_m)/2 \quad (2)$$

where $L_f$ = length of the fiber, $L_m$ = length of the fiber central portion, and wherein $0.5\ L_f < L_m < 0.75\ L_f$.

As it is apparent from equation (1), both the ultimate tensile strength and the ductility of the fiber material as well as the compressive strength of the cement-based material are important factors in defining the optimum amplitude. The equation also takes into account the cross-sectional area and perimeter of the fiber. It is therefore possible to tailor the fiber geometry according to the properties of the fiber and matrix materials chosen, and ultimately to the composite toughness desired in an actual structure.

Where use is made of a cement-based material having a compressive strength $\sigma_c$ ranging from about 30 to about 60 MPa, the value of $k_1(\sigma_c)^{k_2}$ in equation (1) then ranges from about $6 \times 10^{-2}$ to about $7.5 \times 10^{-2}$. A preferred value of $k_1(\sigma_c)^{k_2}$ which provides an optimum amplitude $A_{o,opt}$ in the concrete compressive strength range of 30–60 MPa is about $7 \times 10^{-2}$.

The fiber according to the invention preferably has an end angle $\theta$ less than 20°, the angle $\theta$ being defined by $$\theta = \tan^{-1} \frac{4(A_{o,opt})}{L_s}. \quad (3)$$

The angle $\theta$ preferably ranges from about 12° to about 15°. Such a small end angle $\theta$ prevents the fibers from undergoing balling so that there is no problem with mixing.

The fibers of the invention which have sinusoids only at the end portions as opposed to those that have sinusoids along their entire length, such as in the case of U.S. Pat. No. 4,585,487, provide better reinforcing. At a crack where fibers form stress-transfer bridges and are subjected to pull-out forces, those with deformations over the entire length transmit the entire pull-out force immediately back to the matrix through anchorage. In the case of fibers deformed only at the extremities, the stresses are slowly transferred from the crack face to the interior of the matrix with the major transfer of forces taking place only at the extremities. Such a gradual transfer of stresses averts a possible crushing and splitting of the matrix at the crack face which is commonly observed in fibers deformed all along the length. It is due to the matrix crushing and splitting that fibers unfavorably affect each others ability to reinforce when in a group and the overall toughness of the composite is severely reduced. Since the optimum amplitude of the sinusoid shaped end portions of the fibers according to the invention is defined as a function of the ultimate tensile strength and ductility of the fiber material as well as of the compressive strength of the matrix material, such amplitude is generally less than 5% of the fiber length. The low fiber amplitude leads to a more gradual transfer of stresses back to the matrix and hence less crushing and splitting of the matrix around the fibers.

A particularly preferred metal fiber according to the invention has a uniform rectangular cross-section with a thickness of about 0.4 mm and a width of about 0.8 mm, a length $L_f$ of about 50 mm and a length $L_m$ of about 25 mm. The wavelenth $L_s$ of the sinusoid at each end portion of the fiber is about 12.5 mm.

Fiber reinforced concrete incorporating the fibers of the invention can be used in slabs on grade, shotcrete, architectural concrete, precast products, offshore structures, structures in seismic regions, thin and thick repairs, crash barriers, footings, hydraulic structures and many other applications.

BRIEF DESCRIPTION OF THE DRAWINGS

Further features and advantages of the invention will become more readily apparent from the following description of preferred embodiments, reference being made to the accompanying drawings in which.

DESCRIPTION OF PREFERRED EMBODIMENTS

Figure 1:
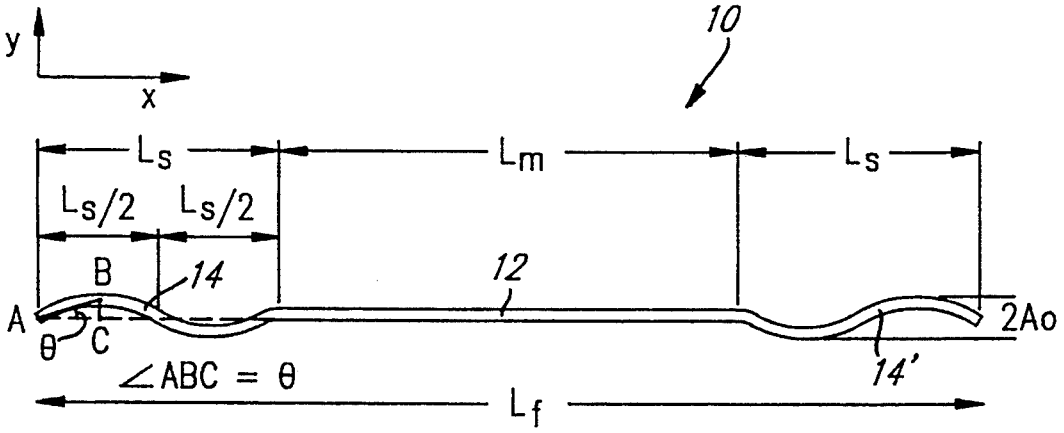
FIG. 1 is a side elevational view of a steel fiber according to the intention.

As shown in FIG. 1, the steel fiber illustrated which is generally designated by reference numeral 10 comprises an elongated, substantially straight central portion 12 with sinusoid shaped end portions 14 and 14'. The sinusoid at each end portion is defined by $$y = A_o \sin \frac{2\pi\chi}{L_s} \quad (4)$$

where the coordinate system is as illustrated in FIG. 1 and $A_o$ is the amplitude of the sinusoid. Also illustrated in FIG. 1 are the length $L_f$ of the fiber 10, the length $L_m$ of the central portion 12 and the length $L_s$ of the end portions 14,14', as well as the end angle $\theta$. The length $L_f$ of the fiber 10 may vary from about 25 to about 60 mm. As explained herein, the fiber geometry is optimized by giving to the sinusoid an optimum amplitude $A_{o,opt}$ as defined in equation (1).

For example, the optimum amplitudes for the following three steels with different mechanical properties are given in Table 1, where $\sigma_c = 40$ MPa and $A_f/P_f = 1.33 \times 10^{-1}$ mm:

TABLE 1

| Steel Type and Properties (bulk) | Optimum Amplitude, $A_{o,opt}$ |
|---|---|
| Steel A: type C1018 ($\sigma_u$ = 1030 MPa; $\epsilon_f$ = 0.60%) | ≈0.7 mm |
| Steel B: Martensite Steel ($\sigma_u$ = 1550 MPa; $\epsilon_f$ = 1%) | ≈1.2 mm |
| Steel C: HSLA* Steel ($\sigma_u$ = 1350 MPa; $\epsilon_f$ = 3.5%) | ≈1.5 mm |

*High Strength Low Aluminum

In the embodiment illustrated in FIG. 1, the fiber 10 has a uniform rectangular cross-section. Such a fiber may also have a circular cross-section.

Fibers with optimized geometry at a dosage rate of 40 kg/m$^3$ were used in reinforcing concrete matrices having an unreinforced compressive strength of 40 MPa. Beams made from the fiber-reinforced concrete were tested in third point flexure, along with their unreinforced companions. The beam displacements were measured using a yoke around the specimen such that the spurious component of the load point displacement due to the settlement of supports was automatically eliminated. The resulting load deflections plots are set forth in FIG. 2, where the toughness of concrete reinforced with the fibers of the invention (F1) is compared with that of concrete reinforced with conventional fibers (F2 to F5). The conventional fibers investigated for comparative purpose were the following:

TABLE 2

| Fiber Designation | Geometry | Cross-Section Shape | Length (mm) | Size (mm) | Tensile Strength (MPA) | Weight (g.) | Number per kg |
|---|---|---|---|---|---|---|---|
| F2 | Hooked-end | Circular | 60 | 0.8 diam. | 1115 | 0.263 | 3800 |
| F3 | Twin-cone | Circular | 62 | 1.0 diam. | 1198 | 0.403 | 2480 |
| F4 | Crimped | Circular | 60 | 1.0 diam. | 1037 | 0.420 | 2380 |
| F5 | Crimped | Crescent | 52 | 2.3 × 0.55 | 1050 | 0.393 | 2540 |

The plots were analyzed according to conventional techniques (ASTM - C1018; JSCE SF-4) as well as to the PCS technique described by J.-F. Trottier, "Toughness of Steel Reinforced Cement-Based Composites", Ph.D. Thesis, Laval University, 1993, the teaching of which is incorporated herein by reference, with a view to determining the toughness parameters. The results are given in Table 3 and plotted in FIG. 3:

TABLE 3

| Post Crack Strength at beam displacement of span/m, $PCS_m$ | Plain Concrete ($\sigma_c$ = 40 MPa; $E_c$ = 39 GPa) | Concrete with F1 Fibers ($\sigma_c$ = 43 MPa; $E_c$ = 39 GPa) |
|---|---|---|
| $PCS_{3000}$ | 0 | 6.3–6.5 MPa |
| $PCS_{1500}$ | 0 | 6.0–6.5 MPa |
| $PCS_{600}$ | 0 | 5.8–6.0 MPa |
| $PCS_{400}$ | 0 | 5.5–5.8 MPa |
| $PCS_{300}$ | 0 | 5.0–5.3 MPa |
| $PCS_{200}$ | 0 | 4.0–4.8 MPa |
| Modulus of Rupture (MOR) | 5.19 MPa | 5.5–5.9 MPa |
| Toughness Indices (ASTM-C1018) | | |
| $I_5$ | 1.0 | 4.7–5.0 |
| $I_{10}$ | 1.0 | 9.0–9.5 |
| $I_{20}$ | 1.0 | 17.2–20.0 |
| $I_{30}$ | 1.0 | 22.0–23.0 |
| $I_{60}$ | 1.0 | 45.0–50.0 |
| JSCE (SF-4) Factor | — | 5.2–5.8 MPa |

In Table 3, $E_c$ is the elastic modulus of concrete as per ASTM C-469. The JSCE SF-4 technique takes the total area (elastic and plastic) under the curve up to a deflection of span/150 and converts into an equivalent post-crack strength.

The fibers of the inventions even at a low dosage of 40 kg/m$^3$ lead to strengthening in the system as evident from the increase in the load carrying capacity over the plain, unreinforced matrix. Also, after the matrix cracking, the composite is capable of carrying approximately the same level of stresses as when at matrix cracking and as such very high toughness is derived. The composite behaves almost in an elasto-plastic manner.

A minor increase (about 7%) in the compressive strength of concrete due to fiber addition indicates that an adequate fiber dispersion and mix compaction were achieved.

Figure 3:
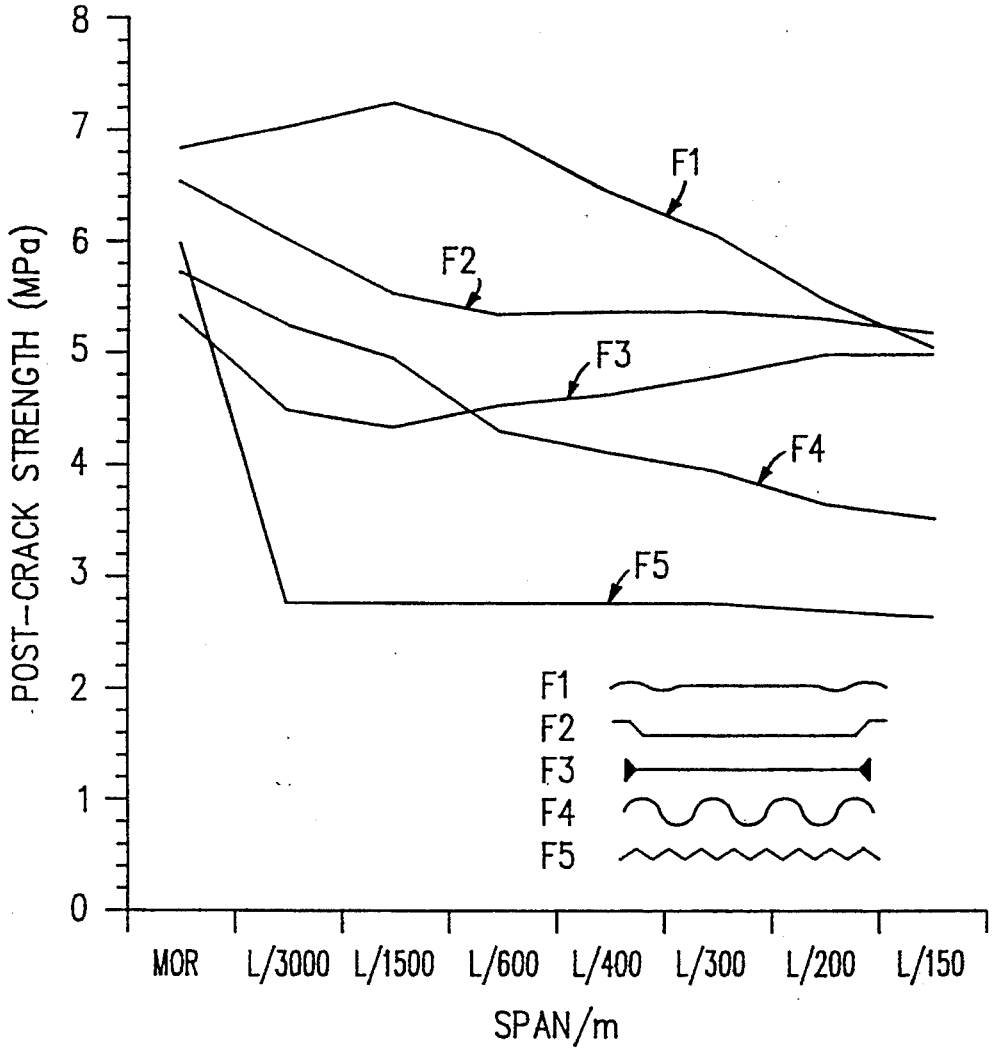
FIG. 3 is a graph showing the relationship between post-crack strength and beam mid-span deflection expressed as a fraction of the span for the same fibers.
Figure 2:
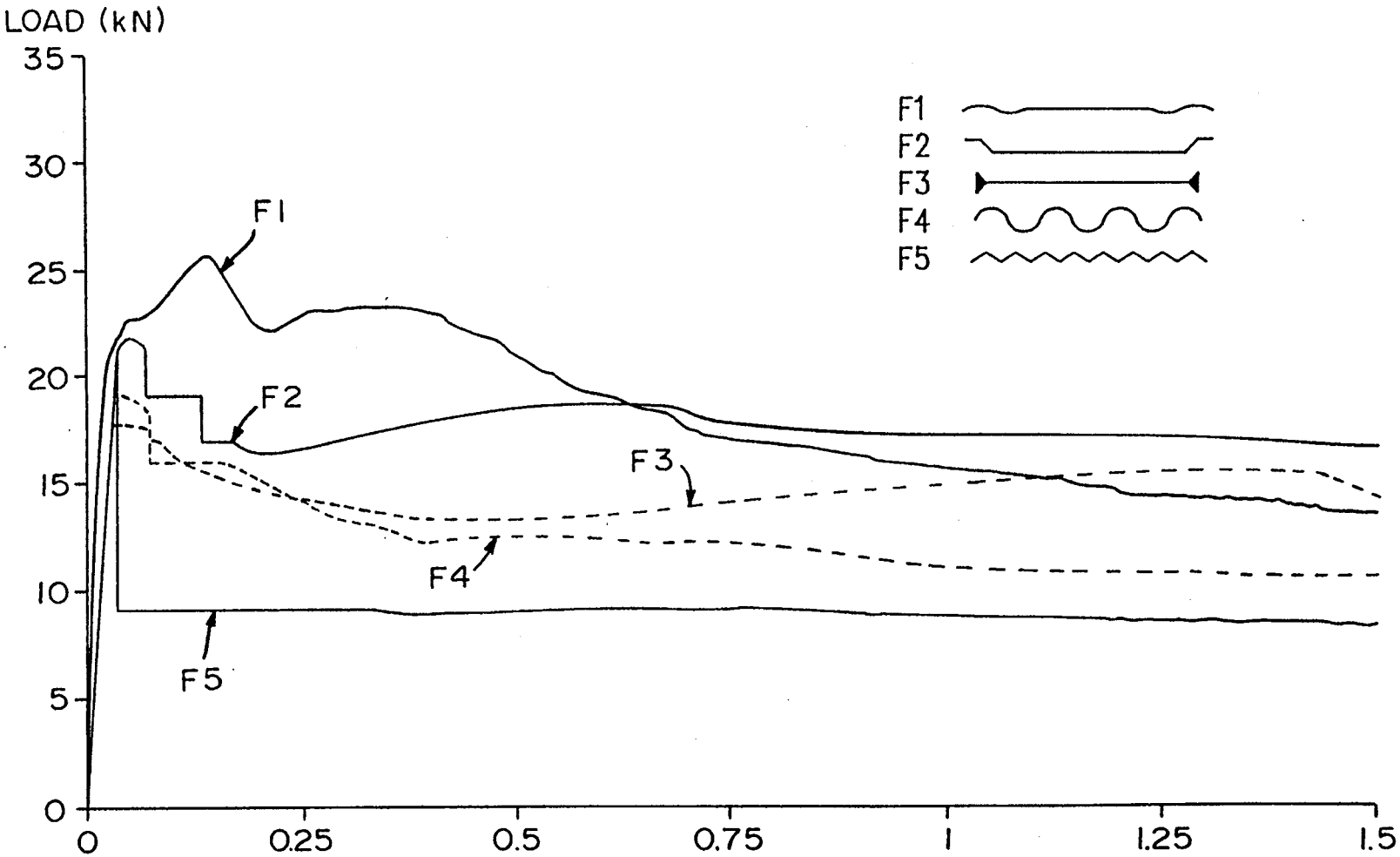
FIG. 2 is a load deflection plot in which the toughness of concrete reinforced with the fiber illustrated in FIG. 1 is compared with that of concrete reinforced with conventional fibers.

As it is also apparent from FIGS. 2 and 3, the fiber with optimized geometry according to the invention behaves superior to existing commercial fibers and provides higher flexural toughness. It is believed that the fiber geometry fully utilizes the potential of steel and that of the cement matrix to produce an optimized composite.

We claim:

1. A metal fiber for reinforcing cement-based materials, which comprises an elongated, substantially straight central portion and sinusoid shaped end portions, the sinusoid of each end portion having an optimum amplitude $A_{o,opt}$ defined by:

$$A_{o,opt}=(k_1(\sigma_c)\ k_2)\ (\sigma_u \alpha \epsilon_f \beta)\ (A_f/P_f)$$

where $k_1=2.025\times10^2$, $\sigma_c$=compressive strength of the cement-based material ranging from about 30 to about 60 MPa, $k_2 3.19\times10^{-1}$, $\sigma_u$=ultimate tensile strength of the metal in MPa, $\alpha=6.60\times10^{-1}$, $\epsilon_f$=ductility of the metal in percent, and $\beta=3.20\times10^{-1}$, $A_f$=cross-sectional area of the fiber in mm$^2$, and $P_f$=perimeter of the fiber in mm, said sinusoid further having a wavelength $L_s$ defined by:

$$L_s=(L_f-L_m)/2$$

where $L_f$=length of the fiber, $L_m$=length of the central portion, and wherein $0.5\ L_f<L_m<0.75\ L_f$.

2. A fiber as claimed in claim 1, wherein the length $L_f$ of the fiber ranges from about 25 to about 60 mm.

3. A fiber as claimed in claim 1, wherein said central portion and said end portions have a uniform rectangular cross-section.

4. A fiber as claimed in claim 3, wherein said central portion and said end portions have a thickness of about 0.4 mm and a width of about 0.8 mm, and wherein the length $L_f$ of the fiber is about 50 mm and the length $L_m$ of the central portion is about 25 mm.

5. A fiber as claimed in claim 1, wherein said central portion and said end portions have a uniform circular cross-section.

6. A fiber as claimed in claim 1, wherein $k_1(\sigma_c)^{k_2}$ ranges from about $6\times10^{-2}$ to about $7.5\times10^{-2}$.

7. A fiber as claimed in claim 6, wherein $k_1(\sigma_c)k_2$ is about $7\times10^{-2}$.

8. A fiber as claimed in claim 7, wherein the cross-sectional area $A_f$ and the perimeter $P_f$ of the fiber are such that $A_f/P_f=1.33\times10^{-1}$ mm.

9. A fiber as claimed in claim 8, wherein said metal is steel.

10. A fiber as claimed in claim 9, wherein said steel is of type C1018 having an ultimate tensile strength $\sigma_u$ of about 1030 MPa and a ductility $\epsilon_f$ of about 0.60%, and wherein said sinusoid has an optimum amplitude $A_{o,opt}$ of about 0.7 mm.

11. A fiber as claimed in claim 9, wherein said steel is a martensite steel having an ultimate tensile strength $\sigma_u$ of about 1550 MPa and a ductility $\epsilon_f$ of about 1%, and wherein said sinusoid has an optimum amplitude $A_{o,opt}$ of about 1.2 mm.

12. A fiber as claimed in claim 9, wherein said steel is a high strength low aluminum steel having an ultimate tensile strength $\sigma_u$ of about 1350 MPa and a ductility $\epsilon_f$ of about 3.5%, and wherein said sinusoid has an optimum amplitude $A_{o,opt}$ of about 1.5 mm.

13. A fiber as claimed in claim 1, wherein said end portions each have an end angle $\theta$ below 20°, the angle $\theta$ being defined by:

$$\theta = \tan^{-1}\frac{4(A_{o,opt})}{L_s}.$$

14. A fiber as claimed in claim 13, wherein said angle $\theta$ ranges from about 12° to about 15°.

15. A metal fiber reinforced cement-based material, which comprises a cement-based material in admixture with metal fibers, said metal fibers each having an elongated, substantially straight central portion and sinusoid shaped end portions, the sinusoid of each end portion having an optimum amplitude $A_{o,opt}$ defined by:

$$A_{o,opt}=[k_1(\sigma_c)^{k_2}][\sigma_u\alpha\epsilon_f\beta][A_f/P_f]$$

where $k_1=2.025\times10^{-2}$, $\sigma_c$=compressive strength of the cement-based material in MPa, $k_2=3.19\times10^{-1}$, $\sigma_u$=ultimate tensile strength of the metal in MPa, $\alpha=6.60\times10^{-1}$, $\epsilon_f$=ductility of the metal in percent, and $\beta=3.20\times10^{-1}$, $A_f$=cross-sectional area of the fiber in mm$^2$, and $P_f$ perimeter of the fiber in mm, said sinusoid further having a wavelength $L_s$ defined by:

$$L_s(L_f-L_m)/2$$

where $L_f$=length of the fiber, $L_m$=length of the central portion, and wherein $0.5\ L_f<L_m<0.75\ L_f$.

16. A metal fiber reinforced cement-based material as claimed in claim 15, wherein the length $L_f$ of the fibers range from about 25 to about 60 mm.

17. A metal fiber reinforced cement-based material as claimed in claim 15, wherein said central portion and said end portions have a uniform rectangular cross-section.

18. A metal fiber reinforced cement-based material as claimed in claim 17, wherein said central portion and said end portions have a thickness of about 0.4 mm and a width of about 0.8 mm, and wherein the length $L_f$ of the fibers is about 50 mm and the length $L_m$ of the central portion is about 25 mm.

19. A metal fiber reinforced cement-based material as claimed in claim 15, wherein said central portion and said end portions have a uniform circular cross-section.

20. A metal fiber reinforced cement-based material as claimed in claim 15, wherein the cement-based material has a compressive strength $\sigma_c$ ranging from about 30 to about 60 MPa and wherein $k_1(\sigma_c)^{k_2}$ ranges from about $6\times10^{-2}$ to about $7.5\times10^{-2}$.

21. A metal fiber reinforced cement-based material as claimed in claim 20, wherein $k_1(\sigma_c)^{k_2}$ is about $7\times10^2$.

22. A metal fiber reinforced cement-based material as claimed in claim 21, wherein the cross-sectional area $A_f$ and the perimeter $P_f$ of the fibers are such that $A_f/P_f=1.33\times10^{-1}$ mm.

23. A metal fiber reinforced cement-based material as claimed in claim 22, wherein said metal is steel.

24. A metal fiber reinforced cement-based material as claimed in claim 23, wherein said steel is of type C1018 having an ultimate tensile strength $\sigma_u$ of about 1030 MPa and a ductility $\epsilon_f$ of about 0.60%, and wherein said sinusoid has an optimum amplitude, $A_{o,opt}$ of about 0.7 mm.

25. A metal fiber reinforced cement-based material as claimed in claim 23, wherein said steel is of martensite steel having an ultimate tensile strength $\sigma_u$ of about 1550 MPa and a ductility $\epsilon_f$ of about 1%, and wherein said sinusoid has an optimum amplitude, $A_{o,opt}$ of about 1.2 mm.

26. A metal fiber reinforced cement-based material as claimed in claim 23, wherein said steel is a high strength low aluminum steel having an ultimate tensile strength $\sigma_u$ of about 1350 MPa and a ductility $\epsilon_f$ of about 3.5%, and wherein said sinusoid has an optimum amplitude, $A_{o,opt}$ of about 1.5 mm.

27. A metal fiber reinforced cement-based material as claimed in claim 15, wherein said end portions each have an end angle $\theta$ below 20°, the angle $\theta$ being defined by:

$$\theta = \tan^{-1}\frac{4(A_{o,opt})}{L_s}.$$

28. A metal fiber reinforced cement-based material as claimed in claim 27, wherein said angle $\theta$ ranges from about 12° to about 15°.

* * * * *